US008143973B2

(12) United States Patent
Barrois et al.

(10) Patent No.: US 8,143,973 B2
(45) Date of Patent: Mar. 27, 2012

(54) CAVITY FILTER COUPLING SYSTEM

(75) Inventors: Pascal Barrois, Sartrouville (FR); Gilles Bourrioux, Montigny (FR)

(73) Assignee: PL Technologies AG, Schindellegi (CH)

( * ) Notice: Subject to any disclaimer, the term of this patent is extended or adjusted under 35 U.S.C. 154(b) by 582 days.

(21) Appl. No.: 12/316,626

(22) Filed: Dec. 15, 2008

(65) Prior Publication Data

US 2009/0261924 A1 Oct. 22, 2009

(30) Foreign Application Priority Data

Dec. 27, 2007 (FR) ..... 07 60404

(51) Int. Cl.
*H01P 1/202* (2006.01)
*H01P 7/06* (2006.01)

(52) U.S. Cl. ..... 333/206; 333/230

(58) Field of Classification Search ..... 333/203, 333/206, 207, 222
See application file for complete search history.

(56) References Cited

U.S. PATENT DOCUMENTS

| | | | | |
|---|---|---|---|---|
| 4,307,357 | A | 12/1981 | Alm | |
| 5,781,085 | A * | 7/1998 | Harrison | 333/202 |
| 6,356,171 | B2 * | 3/2002 | Fiedziuszko et al. | 333/212 |

FOREIGN PATENT DOCUMENTS

| | | | |
|---|---|---|---|
| DE | 10 45 470 | B | 12/1958 |
| DE | 33 29 057 | A1 | 2/1985 |
| EP | 1 258 941 | A | 11/2002 |
| EP | 1 715 544 | A | 10/2006 |
| JP | 55 134502 | A | 10/1980 |
| JP | 57 089301 | A | 6/1982 |

OTHER PUBLICATIONS

Thomas J. B. "Cross-Coupling in Coaxial Cavity Filters-A Tutorial Overview" IEEE Transactions on Microwave Theory and Techniques, IEEE Service Center, Piscataway, NJ, US vol. 51, No. 4, Part 02, Apr. 1, 2003 pp. 1368-1376, XP001145341 ISSN: 0018-9480.
French search report dated Jun. 13, 2008.

* cited by examiner

*Primary Examiner* — Robert Pascal
*Assistant Examiner* — Hardadi Sumadiwirya
(74) *Attorney, Agent, or Firm* — Michael Best & Friedrich LLP

(57) ABSTRACT

The elliptical response bandpass filter according to the invention comprises a plurality N of cavities connected in series by means of in-phase coupling loops; the first cavity is in addition connected to the last by a complementary phase-inversion coupling loop in order to generate transmission zeros at determined frequencies.

2 Claims, 4 Drawing Sheets

CAVITY FILTER COUPLING SYSTEM

This application claims the benefit, under 35 U.S.C. §119 of French Patent Application 0760404, filed Dec. 27, 2007.

BACKGROUND OF THE INVENTION

1. Field of the Invention

The invention relates to power bandpass filters produced by electromagnetic resonance cavities, and more particularly to the coupling structures used to produce high-performance bandpass filters with an elliptical frequency response.

2. Description of the Prior Art

Cavity bandpass filters are used in terrestrial television transmission systems, and more particularly in transmitters operating with frequencies between 40 MHz and 1 GHz. In this frequency range, and for a power between several watts and several tens of kilowatts, these cavities are of the coaxial type.

A television transmission system uses a certain number of bandpass filters, each filter having a passband corresponding to a transmission channel. It therefore allows a narrow band of frequencies to pass, corresponding to a channel without attenuation while blocking the frequencies outside this band.

Cavity bandpass filters are constructed by coupling a certain number of cavities together. The desired order of the filter is obtained by associating several cavities in series. Thus, a second-order Chebyshev bandpass filter is obtained with a single cavity, a fourth-order filter is obtained with 2 cavities, and generally a filter of order 2N is obtained with N cavities.

A coaxial cavity is composed, for example, of an outer conductor of square section and a cylindrical inner conductor. These two conductors are connected at one end by a short-circuit plate, the other end of the inner conductor of length L is free, therefore in an open circuit. If it is excited by an electromagnetic field, this system behaves like an RLC circuit tuned to the frequency $F_0$, where $F_0$ depends on the length L of the conductor:

$$L \approx p\lambda_0/4 \text{ with: } p=1, 3, \ldots 2n+1 \text{ and } \lambda_0=c/F_0$$

Thus the in-series association of these cavities can be obtained by producing a coupling between the cavities in various ways, such as, for example, an aperture in the wall common to the 2 cavities or by means of a conventional coupling loop.

FIG. 1 shows a basic bandpass filter of order 8 obtained with 4 cavities. The filter is composed of cavities 1 to 4 juxtaposed and coupled together by means of conventional coupling loops C12, C23 and C34, connecting the cavities 1 to 2, 2 to 3 and 3 to 4 respectively in series. An input signal $S_{in}$ enters the first cavity through an input coupling element, then propagates into the second cavity, the third cavity, and the fourth and last cavity. A filtered signal $S_{out}$ leaves this last cavity through an output coupling element.

To obtain a conventional Chebyshev filter, the N cavities are simply associated in series and the type of coupling used to couple the cavities to each other is of no importance. The curve obtained with this type of filter is shown in FIG. 2. This transmission curve (1) shows an example of a bandpass function in which the attenuation is very low (point M21) at the central frequency $F_0$ of 2000 MHz, while only at the frequencies of 190 MHz and 210 MHz is the attenuation close to −30 dB (points M22 and M23).

Yet communications systems demand high-performance filters for which the attenuation is low in the passband and this attenuation is very high outside the passband. The transition areas between the areas of low attenuation and high attenuation must be as narrow as possible.

The larger the number of cavities, the steeper the sides of the response curve in the transition areas and the higher the performance of the filter. But the addition of cavities increases the insertion loss, the size, the weight of the filter and the complexity of adjustment.

A microwave filter is described by document EP 0 878 862. This elliptical-response filter comprises complementary coupling means to produce insertion zeros at determined frequencies in the frequency response curve. These insertion zeros are created by the complementary coupling elements constituted by the probes 120, 124.

The invention therefore proposes a topology for a high-performance coaxial cavity bandpass filter with an elliptical response comprising transmission zeros so as to limit the transition areas.

SUMMARY OF THE INVENTION

The invention consists of a power bandpass filter with elliptical response formed by a plurality N of coaxial cavities, N being an even number, and by conventional coupling loops connecting the various associated cavities in series, such that an input signal to be filtered enters at the input terminal of a first cavity, propagates towards the other cavities, and leaves at the output terminal of the last cavity. The filter comprises in addition a complementary phase-inversion coupling loop connecting two non-adjacent cavities.

DESCRIPTION OF THE PREFERRED EMBODIMENTS

The response curve of the filter according to the invention has the advantage of including transmission zeros so as to limit the transition areas.

The filter preferably comprises a complementary phase-inversion coupling loop connecting the first and the last cavity, and inducing in the last cavity a magnetic field in phase opposition to that of the first cavity.

The complementary phase-inversion coupling loop preferably pivots on an axis parallel to the inner conductors of the cavities.

A pivoting phase loop has the advantage of being able to pivot the loop about its axis in order to determine precisely the values of the frequencies of the transmission zeros.

According to variants of the invention, the power bandpass filter according to the invention is formed of 4, 6 or 8 cavities.

Thus the weight of the filter is limited, along with the complexity of adjustment.

BRIEF DESCRIPTION OF THE DRAWINGS

The features and advantages of the invention mentioned above, along with others, will appear more clearly on reading the following description, provided in relation to the attached drawings, in which:

FIG. 3 corresponds to a representation of a 4-cavities filter according to the invention. This filter comprises four cavities 1, 2, 3, 4 juxtaposed and connected in series by conventional coupling loops C12, C23, C34, thus producing a bandpass filter. The invention, consisting in producing a bandpass filter with an elliptic response comprising transmission zeros, is produced by adding a complementary coupling loop C14 in phase opposition which connects the first cavity 1 to the last cavity 4. Elliptical filters are characterized by the steepness of the cut-off, which also determines the minimum attenuation in the attenuated band. While a conventional loop, represented by FIG. 5*a*, collects the magnetic field in a first cavity and creates a magnetic field in the same direction in the following juxtaposed cavity, the complementary phase-inversion loop connecting the first 1 and the last 4 cavity, creates a magnetic field B in the last cavity 4 in phase opposition to that of the first cavity. The loop, along with the induced fields I, are represented by FIG. 5*b*. The effect of all the coupling elements is to create zeros of transmission at certain frequencies and to improve the steepness of the slope corresponding to the sides of the passband. The transition band, lying between the passband having a near zero attenuation and the non-passband having high attenuation, it thus reduced.

As in the conventional bandpass filter of the prior art, an input signal $S_{in}$ enters a first cavity at an input terminal or optionally through an input coupling element, and propagates into a second, then a third and finally a fourth cavity. A filtered signal $S_{out}$ leaves this last cavity through an output terminal or optionally through an output coupling element.

It is, for example, a 20 kW, 4-cavity VHF filter passing a 6 MHz frequency band between the frequencies of 197 MHz and 203 MHz. Two transmission zeros, the values of which are located at frequencies close to 194 and 206 MHz, are created by the complementary phase-opposition coupling loop.

The invention consisting in connecting the first and the last cavities may also be applied to other bandpass filters formed by 6 cavities, 8 cavities or N cavities, N being an even number, connected in series by conventional coupling loops, the first and last cavities being connected by a complementary phase-inversion coupling loop.

The invention also foresees connecting not the first cavity and the last cavity, but the second and penultimate cavities by a complementary phase-inversion coupling loop in order to obtain the anticipated effect.

Likewise, so as to obtain a similar result for an 8-cavity filter, the third and sixth cavities may be connected by a complementary phase-inversion coupling loop.

Figure 1:
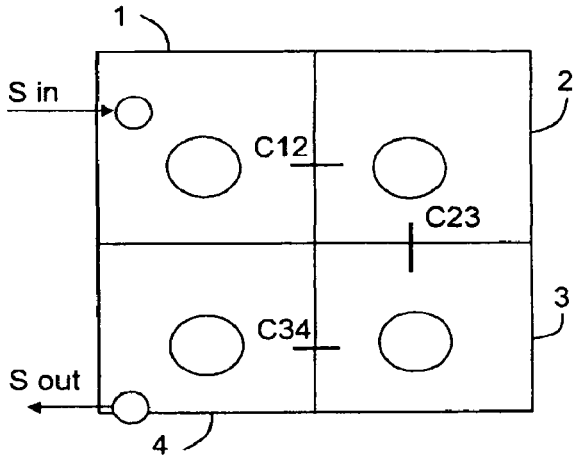
FIG.1 PRIOR ART
FIG. 1, already described, corresponds to a representation of a 4-cavity filter known from the prior art.
Figure 2:
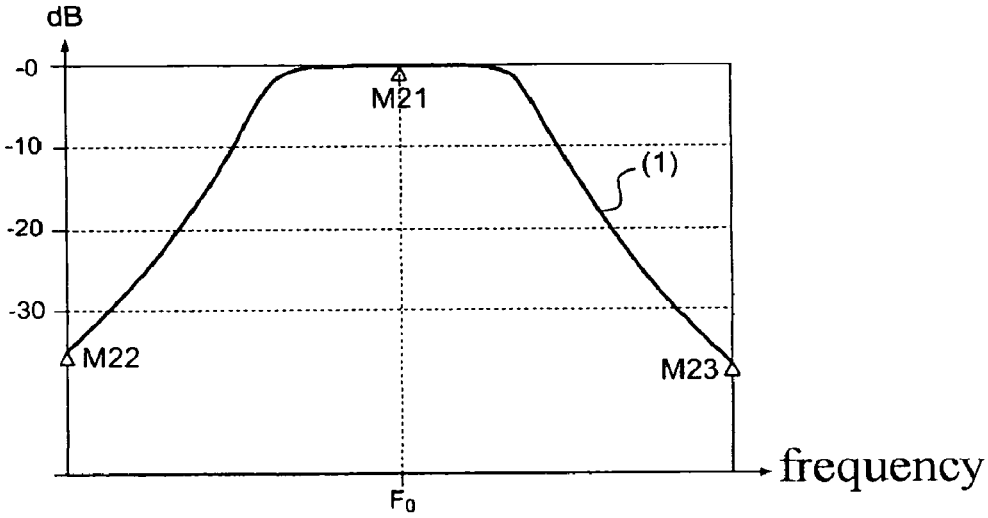
FIG.2 PRIOR ART
FIG. 2 is a diagram corresponding to a frequency response of 4-cavity filter according to the prior art.
Figure 3:
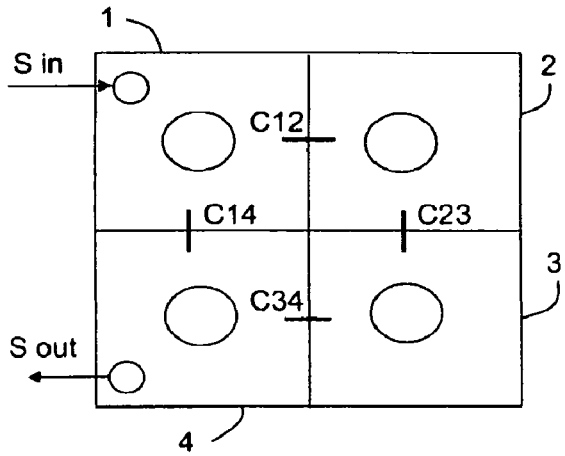
FIG. 3 corresponds to a representation of a 4-cavity filter according to the invention comprising a complementary coupling loop.
Figure 4:
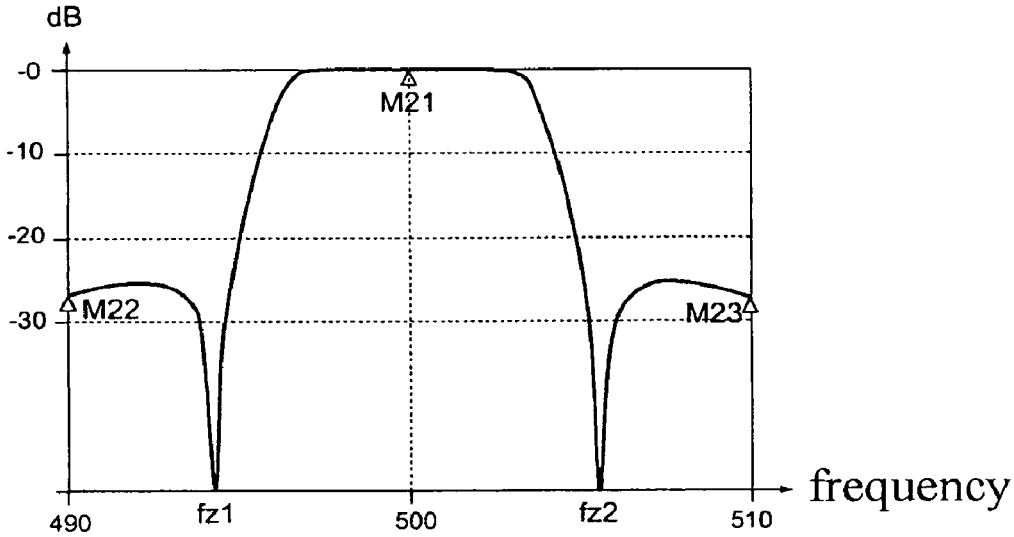
FIG. 4 is a diagram corresponding to a frequency response of 4-cavity filter according to the invention.
Figure 5A:
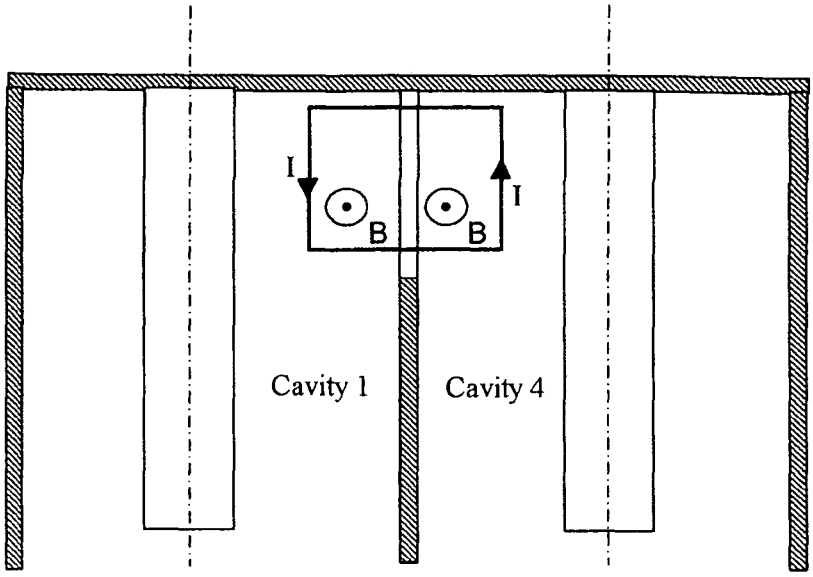
FIG. 5 is a schematic representation of the fields induced by a conventional loop (FIG. 5*a*) and by the complementary loop of the filter according to the invention (FIG. 5*b*)
Figure 5B:
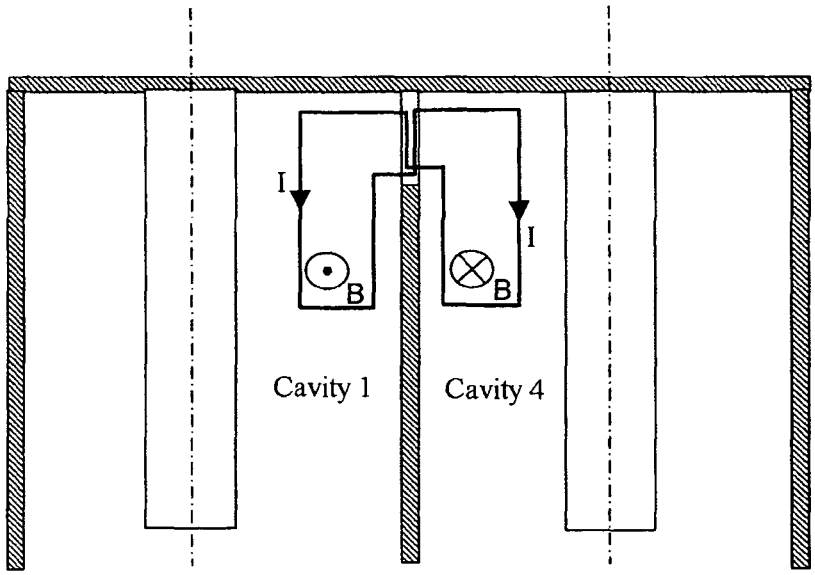

FIG. 4 is a diagram corresponding to a frequency response of a 4-cavity filter according to the invention comprising, in addition to the 3 conventional coupling loops, a complementary phase-inversion coupling loop. This curve comprises 2 transmission zeros at the frequencies $f_{z1}$ and $f_{z2}$. The curve therefore has a steep cut-off at these frequencies, which straighten the sides of the passband. The attenuation in the passband is close to 0 dB whereas it is greater than 25 dB outside the passband, the transition areas of around 2 MHz enabling the production of a high-performance filter.

Figure 6:
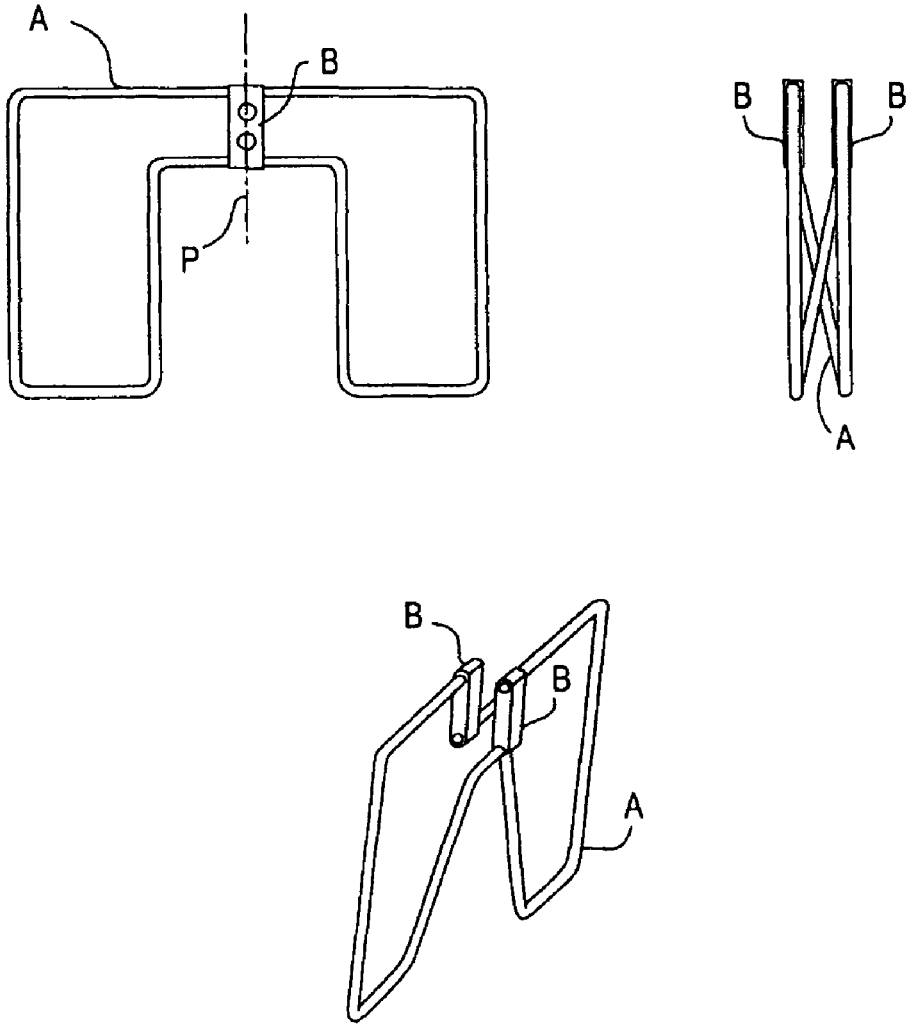
FIG. 6 is a representation of the complementary loop of the filter according to the invention.

FIG. 6 is a representation of a complementary coupling loop according to the invention. A front view, a profile view and a side view represent this loop formed of a curved metal wire A that delimits 2 surfaces determining the coupling coefficient and the ends of which are each connected to a connecting element B. These 2 connecting elements are connected so as to link the ends of the wire to one another and are mounted on a central pivoting axis P. A rotation of this loop about its axis allows the transmission zeros and hence the performance of the passband to be adjusted.

In order to allow the wires of the loop to cross, the connecting elements are in offset planes. The example represents a complementary coupling loop therefore inducing in the last cavity a magnetic field in phase opposition to that of the first cavity.

The invention claimed is:

1. A power bandpass filter with elliptical response, the power bandpass filter formed by a plurality N of coaxial cavities, N being an even number, and by coupling loops connecting the various associated cavities in series, such that an input signal to be filtered enters at the input terminal of a first cavity, propagates towards the other cavities, and leaves at the output terminal of the last cavity, wherein the filter comprises a complementary phase-inversion coupling loop connecting two non-adjacent cavities in the series connection of cavities, and wherein the complementary phase-inversion coupling loop pivots on an axis parallel to inner conductors of the cavities.

2. The power bandpass filter according to claim 1, wherein the filters are formed of 4, 6 or 8 cavities.

* * * * *